US007757871B2

(12) United States Patent
Mautino et al.

(10) Patent No.: US 7,757,871 B2
(45) Date of Patent: Jul. 20, 2010

(54) RAILCAR COUPLER SYSTEM AND METHOD

(75) Inventors: P. Scott Mautino, Pittsburgh, PA (US); Joseph L. Gagliardino, Oakdale, PA (US); Kevin S. Saeler, Stoneboro, PA (US)

(73) Assignee: McConway & Torley, LLC, Pittsburgh, PA (US)

( * ) Notice: Subject to any disclaimer, the term of this patent is extended or adjusted under 35 U.S.C. 154(b) by 177 days.

(21) Appl. No.: 11/567,101

(22) Filed: Dec. 5, 2006

(65) Prior Publication Data

US 2008/0128377 A1 Jun. 5, 2008

(51) Int. Cl.
*B61G 3/00* (2006.01)

(52) U.S. Cl. ..... 213/154; 213/75 R; 213/100 R

(58) Field of Classification Search ..... 213/75 R, 213/7, 100 R, 104, 109, 154
See application file for complete search history.

(56) References Cited

U.S. PATENT DOCUMENTS

| | | | | | |
|---|---|---|---|---|---|
| 341,027 | A | * | 5/1886 | Lorraine | 213/116 |
| 590,488 | A | * | 9/1897 | Smith | 213/118 |
| 904,153 | A | * | 11/1908 | Soheib et al. | 213/124 |
| 991,858 | A | * | 5/1911 | Krakau | 213/154 |
| 1,058,760 | A | * | 4/1913 | Kinne | 213/154 |
| 1,223,491 | A | * | 4/1917 | Janney | 213/154 |
| 1,848,545 | A | * | 3/1932 | Regan | 213/128 |
| 2,162,390 | A | * | 6/1939 | Rydin | 213/104 |
| 2,496,425 | A | * | 2/1950 | Wolfe | 213/109 |
| 2,562,203 | A | * | 7/1951 | Metzger | 213/153 |
| 2,562,504 | A | | 7/1951 | Metzger | 213/151 |
| 2,631,740 | A | * | 3/1953 | Watson | 213/212 |
| 2,645,362 | A | * | 7/1953 | Spence | 213/62 R |
| 2,920,771 | A | * | 1/1960 | Kulieke | 213/154 |
| 3,171,547 | A | | 3/1965 | Whitehouse | 213/100 |
| 3,722,708 | A | * | 3/1973 | Ion et al. | 213/151 |
| 3,854,599 | A | * | 12/1974 | Day et al. | 213/100 R |
| 3,872,978 | A | * | 3/1975 | Altherr | 213/151 |
| 4,135,629 | A | * | 1/1979 | Dilg et al. | 213/153 |
| 4,438,855 | A | * | 3/1984 | Altherr | 213/153 |
| 4,605,133 | A | * | 8/1986 | Altherr | 213/155 |
| 4,984,696 | A | * | 1/1991 | Altherr | 213/151 |
| 5,145,076 | A | * | 9/1992 | Murphy et al. | 213/155 |
| 5,360,124 | A | * | 11/1994 | Wurzer et al. | 213/62 R |

(Continued)

OTHER PUBLICATIONS

PCT; International Search Report and Written Opinion; (IS/EPO) for PCT/US2007/085830 (15 pages), May 19, 2008.

(Continued)

*Primary Examiner*—S. Joseph Morano
*Assistant Examiner*—Jason C Smith
(74) *Attorney, Agent, or Firm*—Baker Botts L.L.P.

(57) ABSTRACT

A railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion towards the shank portion. The guard arm portion comprises a minimum height less than a height of the shank portion where the guard arm portion meets the shank portion.

16 Claims, 5 Drawing Sheets

U.S. PATENT DOCUMENTS

| | | | | |
|---|---|---|---|---|
| 6,148,733 | A * | 11/2000 | Gagliardino | 105/154 |
| 2005/0184021 | A1 * | 8/2005 | Mautino et al. | 213/118 |
| 2006/0113267 | A1 * | 6/2006 | Mautino et al. | 213/118 |
| 2007/0125510 | A1 * | 6/2007 | Mautino et al. | 164/137 |
| 2008/0083690 | A1 * | 4/2008 | Mautino et al. | 213/152 |
| 2008/0128377 | A1 * | 6/2008 | Mautino et al. | 213/75 R |

OTHER PUBLICATIONS

PCT; Notification Concerning Transmittal of International Preliminary Report on Patentability (Chapter I) for PCT/US2007/085830 (8 pages), Jun. 18, 2009.

* cited by examiner

RAILCAR COUPLER SYSTEM AND METHOD

TECHNICAL FIELD OF THE INVENTION

This invention relates in general to railcars and, more particularly, to a railcar coupler system and method.

BACKGROUND OF THE INVENTION

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

SUMMARY OF THE INVENTION

The present invention provides a railcar coupler system and method that substantially eliminates or reduces at least some of the disadvantages and problems associated with previous systems and methods.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion towards the shank portion. The guard arm portion comprises a minimum height less than a height of the shank portion where the guard arm portion meets the shank portion.

The guard arm portion may comprise a guard arm nose height where the guard arm portion meets the nose portion of the coupler head portion. The nose height may be less than a height of the nose portion. The guard arm portion may comprise a top surface with no cavity openings. The guard arm portion may be coupled to the coupler head portion after casting the coupler head portion. The guard arm portion may be cast with no internal cavities.

In accordance with another embodiment, a method for manufacturing a railcar coupler includes casting a coupler head portion extending from a shank portion. The coupler head portion is configured to couple to a first coupler knuckle for coupling the railcar coupler to a second railcar coupler of an adjacent railcar. The coupler head portion includes a nose portion and a gathering face extending from the nose portion for engaging a second coupler knuckle coupled to the second railcar coupler. The method includes casting a guard arm portion and coupling the guard arm portion to the coupler head portion such that the guard arm portion extends from the nose portion towards the shank portion. Casting a guard arm portion may comprise casting a guard arm portion with no internal cavities.

Technical advantages of particular embodiments include a coupler having a guard arm portion that is smaller and narrower than conventional guard arm portions. In addition, guard arm portions in some embodiments may not include internal cavities formed by cores. Thus, the process of inspection to ensure that couplers and associated guard arm portions meet desired standards and criteria is eased. In addition, with the lack of cavities and associated sidewalls and the simplified guard arm portion configuration, the finishing process for the coupler and guard arm portion in particular is simplified. The smaller guard arm portion size may also reduce the total weight of the coupler. In addition, some embodiments include the process of manufacturing a coupler by attaching a guard arm portion to a coupler body after the coupler body has been cast which reduces complexities in the coupler manufacturing process. Moreover, some embodiments may include a chain lug hole on the guard arm portion and formed after casting through a drilling, punching or other process thereby reducing additional labor and expense in the manufacturing process.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
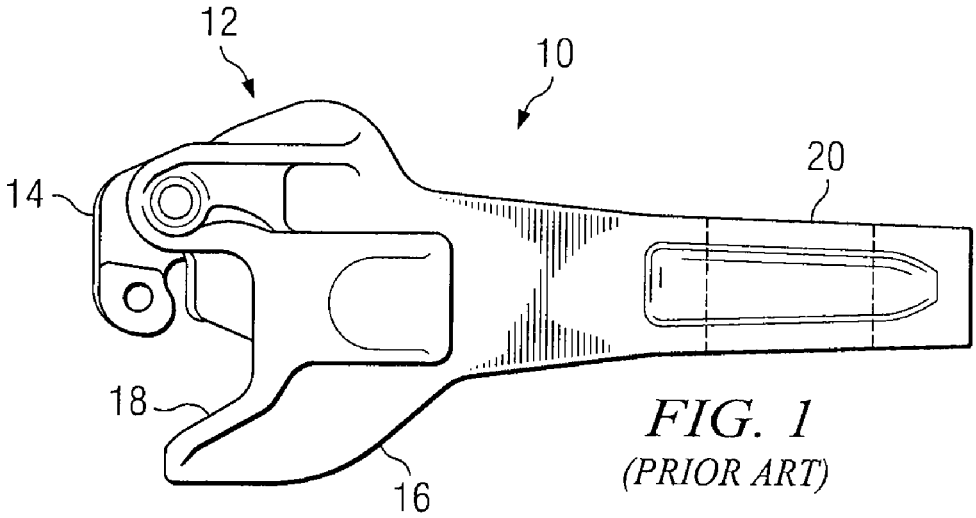
FIG. 1 (PRIOR ART)
FIG. 1 is a top view of a typical railcar coupler.
Figure 2:
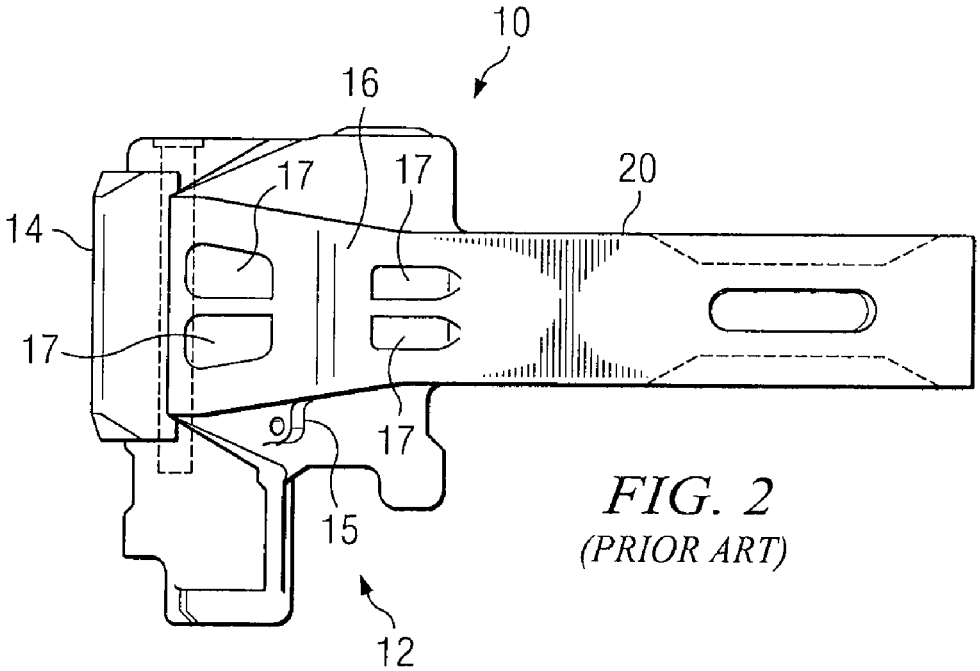
FIG. 2 (PRIOR ART)
FIG. 2 is a side view of the railcar coupler of FIG. 1.

FIGS. 1 and 2 illustrate a coupler 10 for freight railway cars in accordance with standard specifications as set forth by the Mechanical Committee of Standard Coupler Manufacturers. Coupler 10 is mounted within a yoke secured at each end of a railway car center sill, such that it may extend outwardly under an end of a railway car to engage a similar coupler extending outwardly under an end of an adjacent railway car. Coupler 10 includes a generally V-shaped coupler head 12 at a forward end extending from a shank 20. Shank 20 is adapted to be fitted within and attached to a yoke secured at each end of a center sill extending full length under the railway car at a longitudinal axis.

Coupler head 12 has a vertical-knuckle 14 rotatably pinned at an outer end of coupler head 12 forming a first leg of coupler head 12, while a second leg of coupler head 12 comprises a fixed and rigid guard arm portion 16 with cavities 17. Coupler 10 also includes a first angled gathering surface 18 against which a vertical-knuckle 14 on a mating coupler similar to coupler 10 is intended to impact when two adjacent railway cars are brought together. When vertical knuckle 14 impacts against an angled gathering face 18 of another coupler, it and the opposing vertical knuckle 14 are each pivoted inwardly to a degree sufficient to lock them in place behind each other so that the couplers 10 are properly joined together. A lock member slidably disposed within each coupler head 12 may be activated by the engagement to slide downwardly within the coupler head 12 and lock the vertical knuckle 14 in place to thereby join the two railway cars together. Coupler 10 additionally includes a chain lug 15.

To assure a successful coupling, the two railway cars may be sitting on a straight length of track, and the two couplers, like coupler 10, may be at least generally oriented parallel to the track and perpendicular to the end of the railway car to face each other. In some cases, couplers may include features such as extended guard arm portions, as illustrated in U.S. Pat. No. 6,148,733, that facilitate railway car coupling when the railway cars are sitting on a length of curved track or are otherwise not aligned with each other.

Figure 3:
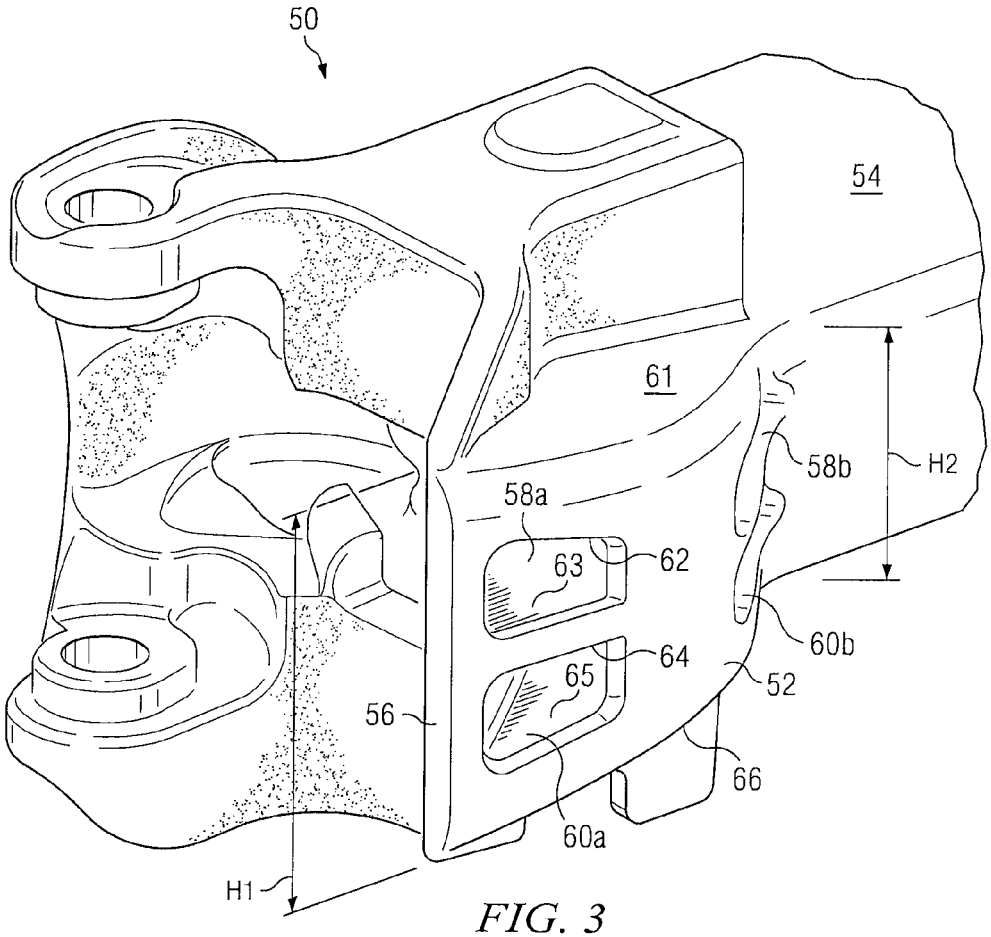
FIG. 3 (PRIOR ART)
FIG. 3 is an isometric view of a railcar coupler having a conventional guard arm portion.

FIG. 3 is an isometric illustration of a coupler 50 with a conventional guard arm portion 52. Guard arm portion 52 extends from a shank 54 to nose portion 56 of coupler 50. The slope and configuration of guard arm portion 52 provide strength and stability coupler 50, particularly to the portion extending from nose portion 56 towards shank 54. This may reduce the chance of failure of the coupler during operation.

As illustrated, a conventional guard arm portion 52 has a top height H1 as tall as nose portion 56 of coupler 50. In addition, the minimum height H2 of guard arm portion 52 is approximately the same height as shank 54. As evident, this minimum height H2 occurs where guard arm portion 52 meets the shank.

As illustrated, a conventional guard arm portion 52 includes cavities 58 and 60. The presence of cavities 58 and 60 in the guard arm lighten the total weight of the coupler. However, they also may contribute to failure of the coupler at the guard arm, particularly since the guard arm includes thinner portions of metal as a result of the cavities. In addition, guard arm portion 52 and cavities 58 and 60 form six generally straight sidewalls 61-66 comprising two exterior sidewalls 61 and 66 and four interior sidewalls 62-65. The process of finishing these sidewalls after the coupler is cast may be time consuming and may add labor and expense to the production of the coupler.

Coupler 50 having guard arm portion 52 is manufactured through a casting process with steel or other alloy. Typically one or more cores are used in the manufacturing process in order to form cavities 58 and 60. The cores are typically made of resin or otherwise hardened sand. Specifically, the coupler 50 may be produced in a mold cavity within a casting box between cope and drag sections. Sand, such as green sand, is used to define the interior boundary walls of the mold cavity. The mold cavity may be formed using a pattern and may include a gating system for allowing molten alloy to enter the mold cavity. The mold cavity defines the exterior surfaces of coupler 50, including the exterior surface of guard arm portion 52. The cores used to form cavities 58 and 60 are placed at an appropriate location within the mold cavity. Once the coupler is cast, the sand or resin cores may be removed leaving cavities 58 and 60. Coupler 50 may undergo a metal finishing process that includes finishing the interior surfaces of cavities 58 and 60, including interior sidewalls 62-65.

Figure 4:
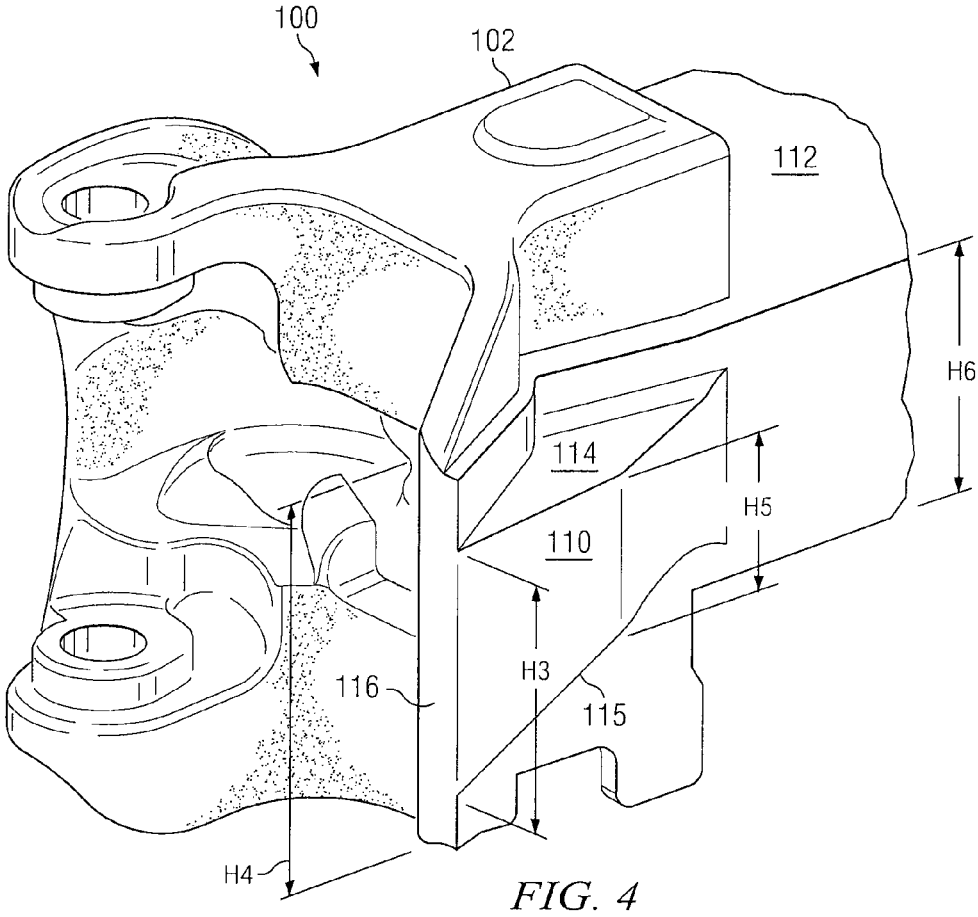
FIG. 4 is an isometric view of a railcar coupler having a guard arm portion in accordance with a particular embodiment.

FIG. 4 illustrates a coupler 100 having a guard arm portion 110, in accordance with a particular embodiment of the present invention. Coupler 100 includes a coupler body 102 independent of guard arm portion 110. Guard arm portion 110 comprises a solid metal portion without internal cavities such as cavities 58 and 60 of guard arm portion 52 of coupler 50. Thus, guard arm portion 110 includes only two generally straight sidewalls 114 and 115. As evident, sidewalls 114 and 115 are exterior sidewalls, and guard arm portion 110 does not include interior sidewalls similar to interior sidewalls 62-65 of guard arm portion 52 formed as a result of cavities 58 and 60.

In addition, the size and shape of guard arm portion 110 is different from that of conventional guard arm portion 52 of coupler 50. For example, a height H3 of guard arm portion 110 where the guard arm portion meets a nose portion 116 of the coupler is less than a height H4 of the nose portion. In addition, the minimum height H5 of the guard arm portion is less than a height H6 of shank 112.

As discussed above, guard arm portion 110 does not include cavities such as cavities 58 and 60 of guard arm portion 52 of coupler 50. However, despite not having such cavities, guard arm portion 110 does not add significantly more weight to coupler 100 because it is smaller in size than conventional guard arm portion 52. As discussed, it has smaller heights and does not extend all the way to shank 112. Despite its smaller size, guard arm portion 110 still provides significant strength and stability to the coupler, particularly to the portion of the coupler extending from nose portion 116 towards shank 112 under guard arm portion 110.

It should be understood that guard arm portion 110 of coupler 100 is one example of a guard arm portion in accordance with particular embodiments and that guard arm portions of other embodiments may comprise different sizes and configurations. Guard arm portions of other embodiments may have heights and slopes different from guard arm portion 110 and may extend to the shank of a coupler. For example, some embodiments may include a guard arm portion having a height at a particular point, such as where the guard arm portion meets the nose portion of the coupler, that is substantially similar to the height of a conventional guard arm portion at such point. In addition, guard arm portions may have minimum and maximum heights at any suitable locations of the guard arm portions. Moreover, while particular embodiments are illustrated herein as Type E couplers, other embodiments may include similar features and configurations in other types of couplers, such as Type F or H couplers.

In some embodiments, guard arm portion 110 may be used on a coupler having an extended or expanded gathering range, such as couplers illustrated and described in U.S. Pat. No. 6,148,733 entitled "Type E Railway Coupler with Expanded Gathering Range," which is hereby incorporated by reference herein.

In addition to its unique shape and configuration, the manufacturing process of coupler 100 with guard arm portion 110 differs from that of coupler 50 having conventional guard arm portion 52. In accordance with a particular embodiment, coupler body 102 is cast without guard arm portion 110 using a typical casting process with steel or other alloy. For example, as discussed above with respect to coupler 50, coupler body 102 may be produced in a mold cavity within a casting box between cope and drag sections. Sand may be used to define the interior boundary walls of the mold cavity. The mold cavity may be formed using a pattern and may include a gating system for allowing molten alloy to enter the mold cavity. The mold cavity defines the exterior surfaces of coupler body 102. Since, as indicated above, coupler body 102 is cast without guard arm portion 110, the mold cavity may have a different configuration than a mold cavity used to produce coupler 50. For example, the mold cavity used to produce coupler body 102 will not include a cavity section defining guard arm portion 110.

Guard arm portion 110 may be independently produced using any suitable method, such as a casting process similar to that used to produce coupler 50 and coupler body 102. In this case, a mold cavity may be designed to define the outer surfaces of guard arm portion 110. As indicated above, guard arm portions in other embodiments may include shapes and/or configurations different from guard arm portion 110, and thus mold cavities used to form other guard arm portions may be different from a mold cavity used to form guard arm portion 110.

Once guard arm portion 110 has been produced, it is attached to coupler body 102 which was independently formed without a guard arm portion. Such attachment may be accomplished using any suitable method, such as by welding guard arm portion 110 to coupler body 102.

Figure 5A:
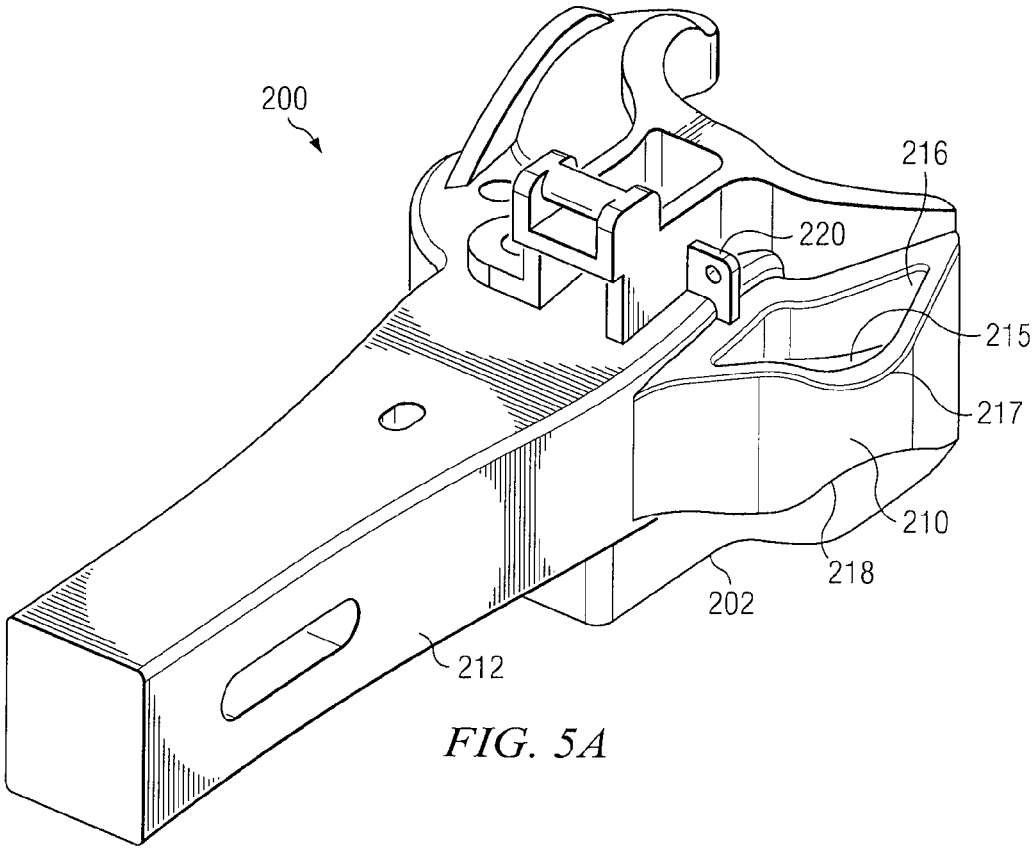
FIG. 5A is an isometric view of a railcar coupler having a guard arm portion and a chain lug in accordance with a particular embodiment.
Figure 5B:
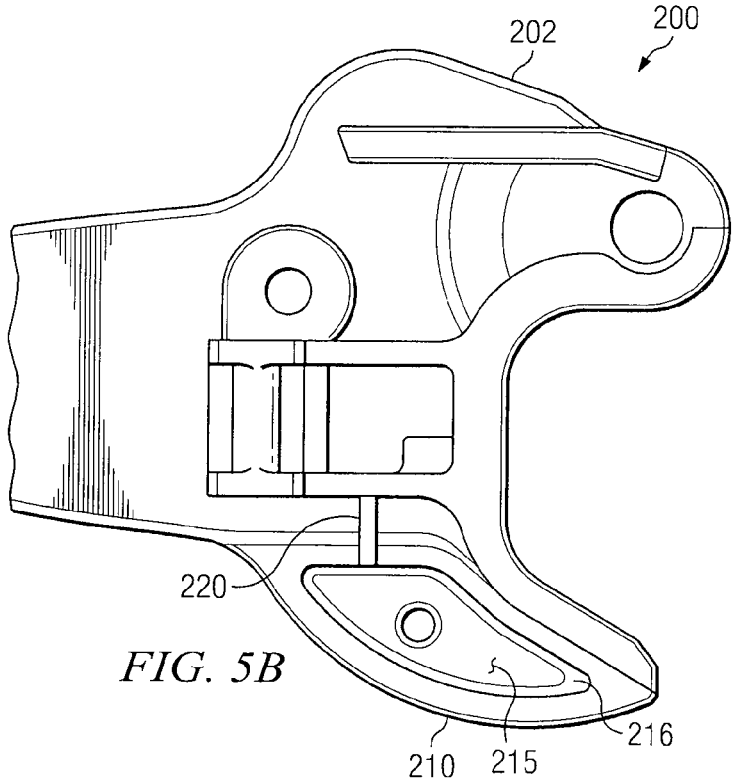
FIG. 5B is another isometric view of the coupler of FIG. 5A.

FIGS. 5A and 5B illustrates a coupler 200 having a guard arm portion 210 and a chain lug 220, in accordance with a particular embodiment of the present invention. Coupler 200 includes a coupler body 202 independent of guard arm portion 210 and extending from a shank portion 212. Guard arm portion 210 comprises a solid metal portion without internal cavities such as cavities 58 and 60 of guard arm portion 52 of coupler 50. Guard arm portion 210 includes two sidewalls, one of which can be seen in the illustrations—sidewall 215. In this embodiment, sidewall 215 is positioned in a recessed portion 216 of guard arm portion 210. As is the case in FIG. 4, other embodiments may not include such recessed portions. The use of recessed portion 216 (and the corresponding recessed portion on the other side of guard arm 210) reduces the weight of the coupler.

As evident, guard arm portion 210 is configured differently than other embodiments discussed herein. For example, guard arm portion 210 includes curved edges 217 and 218 that curve internally in the center portion of the guard arm portion. Other embodiments may include other shapes, sizes and configurations.

As indicated above, coupler 200 includes chain lug 220 which joins to guard arm portion 210. The chain lug may be used to support hoses (such as air line hoses) and other components when the coupler is not operational or otherwise not connected. Chain lugs in some couplers may be located on a coupler lock chamber.

The manufacturing process related to the placement of the chain lug on the coupler may be different than in conventional couplers. In conventional couplers, the chain lug may be formed through the core process used in the coupler manufacturing process. However, in the illustrated embodiment, chain lug 220 may be cast without its hole, and then the hole may be located using a drill, punch or other method. This method of mechanically deducing the hole may result in a less time consuming and more precise manufacturing process for the chain lug.

Figure 6:
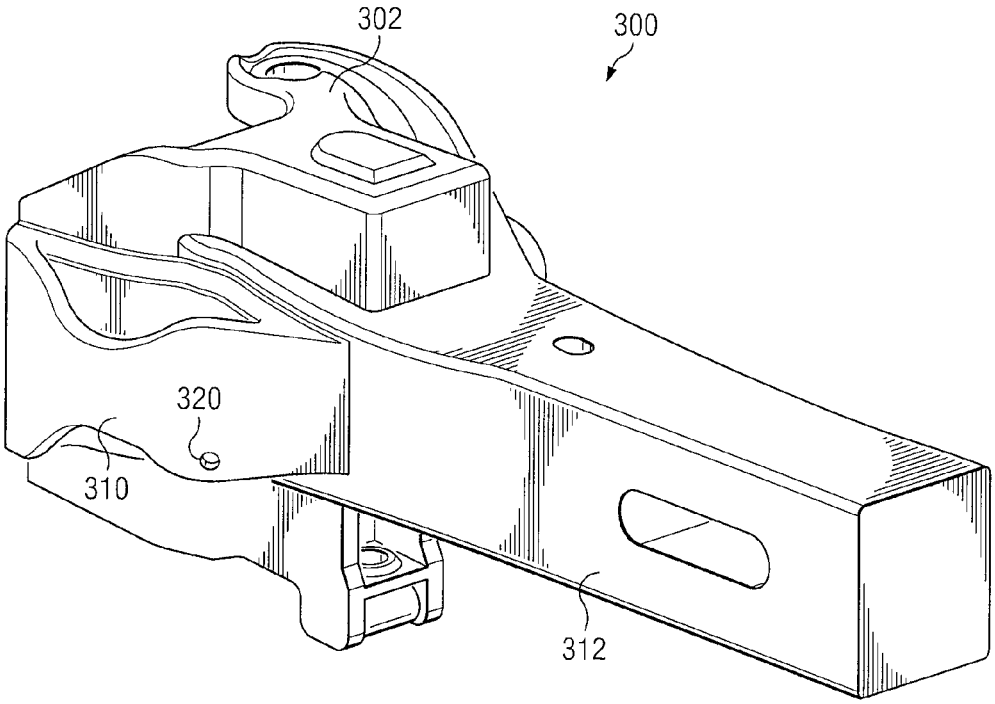
FIG. 6 is an isometric view of a railcar coupler having a guard arm portion with a chain lug hole in accordance with a particular embodiment.

FIG. 6 illustrates a coupler 300 having a guard arm portion 310 and a chain lug 320, in accordance with a particular embodiment. Coupler 300 includes a coupler body 302 independent of guard arm portion 310 and extending from shank portion 312. Guard arm portion 310 comprises a solid metal portion without internal cavities similar to guard arm portion 210 of FIGS. 5A and 5B.

In this embodiment, chain lug 320 comprises a hole positioned on guard arm portion 310 (as opposed to the chain lug being coupled to the guard arm portion as illustrated in FIG. 5). Such positioning on the guard arm portion and near the head of the coupler provides a good location for support of the hoses and other components since they may be more fully extended when supported at the chain lug than if the chain lug were positioned further back on the coupler. In addition, chain lug 320 may be formed through a drill, punch or other process after the coupler is manufactured. Being able to form the chain lug without having to manipulate a core for the chain lug results in a more precise and less time consuming process for coupler manufacturing.

As indicated above, particular embodiments discussed herein include couplers having guard arm portions of various shapes, sizes and configurations and having various types of chain lugs positioned in various places on the coupler. Embodiments of the present invention may combine one or more of the various guard arm portion and chain lug features and/or elements discussed herein.

As indicated, particular embodiments include a coupler having guard arm portions which are smaller and narrower than conventional guard arm portions. In addition, guard arm portions in some embodiments may not include internal cavities. Thus, the process of inspection to ensure that couplers and associated guard arm portions meet desired standards and criteria is eased. In addition, with the lack of cavities and associated sidewalls and the simplified guard arm portion configuration, the finishing process for the coupler and guard arm portion in particular is simplified. The smaller guard arm portion size also reduces the total weight of the coupler. Moreover, in some embodiments the chain lug may be positioned on the guard arm portion and may be formed using a simpler punch or drill process thereby reducing time and labor in the coupler manufacturing process.

In addition, the process of manufacturing a coupler by attaching a guard arm portion to a coupler body after the coupler body has been cast reduces complexities in the coupler manufacturing process. For example, a mold cavity used to form the exterior shape of the coupler body may be less complex than that used for a conventional coupler. In addition, one or more cores used to form cavities in guard arm portions of conventional couplers may not be needed. This again simplifies the manufacturing process and reduces the amount of labor and materials, such as core resin, needed to manufacturer the coupler.

Although the present invention has been described in detail with reference to particular embodiments, it should be understood that various other changes, substitutions, and alterations may be made hereto without departing from the spirit and scope of the present invention. The present invention contemplates great flexibility in the manufacturing process of coupler knuckles and the shape, configuration and arrangement of one or more internal cores used in the manufacturing process.

Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railcar coupler, comprising:

a coupler head portion extending from a shank portion, the coupler head portion configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler;

the coupler head portion comprising a guard arm portion extending from the nose portion towards the shank portion; and wherein the guard arm portion comprises a guard arm nose height where the guard arm portion meets the nose portion of the coupler head portion, the guard arm nose height less than a height of the nose portion.

2. The railcar coupler of claim 1, wherein the guard arm portion comprises a side surface with no cavity openings.

3. The railcar coupler of claim 1, wherein the guard arm portion is coupled to the coupler head portion after casting the coupler head portion.

4. The railcar coupler of claim 1, wherein the guard arm portion is cast with no internal cavities.

5. The railcar coupler of claim 1, wherein the guard arm portion comprises a chain lug hole.

6. The railcar coupler of claim 1, wherein the guard arm portion comprises a minimum height less than a height of the shank portion where the guard arm portion meets the shank portion.

7. The railcar coupler of claim 1, wherein the guard arm portion is cast with internal cavities.

8. The railcar coupler of claim 1, wherein the guard arm portion includes no internal cavities.

9. A railcar coupler, comprising:

a coupler head portion extending from a shank portion, the coupler head portion configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler;

the coupler head portion comprising a guard arm portion extending from the nose portion towards the shank portion, the guard arm portion comprising a side surface generally extending along a height of the guard arm portion with no cavity openings; and wherein the guard arm portion comprises a height at a location of the guard arm portion that is less than a height of the coupler head portion at the location.

10. The railcar coupler of claim 9, wherein the guard arm portion comprises a minimum height less than a height of the shank portion where the guard arm portion meets the shank portion.

11. The railcar coupler of claim 9, wherein the guard arm portion comprises a guard arm nose height where the guard arm portion meets the nose portion of the coupler head portion, the guard arm nose height less than a height of the nose portion.

12. The railcar coupler of claim 9, wherein the guard arm portion is coupled to the coupler head portion after casting the coupler head portion.

13. The railcar coupler of claim 9, wherein the guard arm portion is cast with no internal cavities.

14. The railcar coupler of claim 9, wherein the guard arm portion comprises a chain lug hole.

15. The railcar coupler of claim 9, wherein the guard arm portion is cast with internal cavities.

16. The railcar coupler of claim 9, wherein the guard arm portion includes no internal cavities.

* * * * *